US010442204B2

(12) United States Patent
De Saint Romain et al.

(10) Patent No.: US 10,442,204 B2
(45) Date of Patent: Oct. 15, 2019

(54) INKJET PRINTER WITH IMPROVED SOLVENT RECOVERY CIRCUIT

(71) Applicant: Dover Europe Sàrl, Vernier (CH)

(72) Inventors: Pierre De Saint Romain, Valence (FR); Adrien Marion, Lyons (FR); Jean Xing, Bourg les Valence (FR); Bruno Barbet, Etoile-sur-rhone (FR)

(73) Assignee: DOVER EUROPE SÀRL, Vernier (CH)

( * ) Notice: Subject to any disclaimer, the term of this patent is extended or adjusted under 35 U.S.C. 154(b) by 26 days.

(21) Appl. No.: 15/379,798

(22) Filed: Dec. 15, 2016

(65) Prior Publication Data

US 2017/0173961 A1 Jun. 22, 2017

(30) Foreign Application Priority Data

Dec. 22, 2015 (FR) ..... 15 63126

(51) Int. Cl.

| | |
|---|---|
| ***B41J 2/165*** | (2006.01) |
| ***B41J 2/175*** | (2006.01) |
| ***B41J 2/185*** | (2006.01) |
| ***B41J 29/377*** | (2006.01) |

(52) U.S. Cl.

CPC ..... *B41J 2/16517* (2013.01); *B41J 2/175* (2013.01); *B41J 2/185* (2013.01); *B41J 29/377* (2013.01)

(58) Field of Classification Search

None

See application file for complete search history.

(56) References Cited

U.S. PATENT DOCUMENTS

| | | | | |
|---|---|---|---|---|
| 4,324,052 | A * | 4/1982 | Bosher | F26B 21/08 34/471 |
| 4,469,720 | A * | 9/1984 | Morris | B05B 15/1233 118/61 |
| 7,192,121 | B2 | 3/2007 | Barbet et al. | |
| 8,540,350 | B2 | 9/2013 | Barbet | |

(Continued)

FOREIGN PATENT DOCUMENTS

| | | |
|---|---|---|
| CN | 102470729 A | 5/2012 |
| FR | 2954216 A1 | 6/2011 |

(Continued)

OTHER PUBLICATIONS

French Search Report issued in Patent Application No. FR 1563126 dated Aug. 11, 2016.

(Continued)

*Primary Examiner* — Alejandro Valencia

(74) *Attorney, Agent, or Firm* — Pearne & Gordon LLP

(57) ABSTRACT

The invention relates to a circuit (100) for recovery of vaporized solvent in a cavity (5) in a print head of an inkjet printer, comprising: a double flow heat exchanger (30) comprising a first circuit between a first inlet (35) and a first outlet (36), for a gas flow from said cavity, this exchanger comprising a second circuit thermally coupled to the first circuit and located between a second inlet (37) and a second outlet (39), a condenser (8) with an inlet (35) with fluid coupling to the first outlet (36) from the exchanger, along the direction of circulation of the gas flow, and an outlet (86), with fluid coupling to the second inlet (37) of the double flow exchanger (30).

13 Claims, 8 Drawing Sheets

(56) References Cited

U.S. PATENT DOCUMENTS

| | | | | |
|---|---|---|---|---|
| 2003/0176748 | A1* | 9/2003 | Kammerhofer | C07C 17/156<br>570/203 |
| 2007/0064066 | A1* | 3/2007 | Piatt | B41J 2/03<br>347/74 |
| 2012/0234517 | A1* | 9/2012 | Ogasawara | F25B 40/00<br>165/104.21 |
| 2012/0299989 | A1 | 11/2012 | Prothon et al. | |
| 2012/0306949 | A1 | 12/2012 | Rolland | |
| 2014/0050868 | A1 | 2/2014 | De Saint-Romain | |
| 2014/0065381 | A1 | 3/2014 | De Saint Romain | |
| 2015/0368486 | A1 | 12/2015 | De Saint-Romain | |
| 2016/0067962 | A1 | 3/2016 | De Saint Romain | |
| 2016/0075897 | A1 | 3/2016 | Barbet et al. | |
| 2016/0082746 | A1 | 3/2016 | De Saint Romain | |
| 2016/0289473 | A1 | 10/2016 | De Saint Romain | |

FOREIGN PATENT DOCUMENTS

| | | | |
|---|---|---|---|
| WO | 2010/019855 | A2 | 2/2010 |
| WO | 2012/038520 | A1 | 3/2012 |
| WO | 2013/150682 | A1 | 10/2013 |
| WO | 2013/173200 | A1 | 11/2013 |

OTHER PUBLICATIONS

U.S. Appl. No. 15/302,734, "Sturdy Drop Generator" filed Oct. 7, 2016.

Office Action and tranlsation for CN201611198782.X dated Aug. 29, 2019.

* cited by examiner

INKJET PRINTER WITH IMPROVED SOLVENT RECOVERY CIRCUIT

TECHNICAL DOMAIN AND PRIOR ART

The invention relates to continuous inkjet printers, and particularly but not exclusively to binary inkjet printers provided with a multi-nozzle drop generator. It is aimed particularly at improving an ink and solvent recovery circuit for these printers.

Continuous jet printers comprise:

an ink drop generator, means of separating trajectories of drops generated by the generator and directing them towards a printing support or to a catcher.

FIG. 1 show the main modules in an inkjet printer. In a known manner, the printer comprises a console 300, a compartment 400 containing in particular ink and solvent conditioning circuits, and reservoirs for the ink and solvents. In general, the compartment 400 is in the lower part of the console. The top part of the console comprises the control and instrumentation electronics and display means. The console is hydraulically and electrically connected to a print head 1 through an umbilical 200. A portal frame not shown is used to install a print head facing a print support 800. The print support 800 moves along a direction represented by an arrow. This direction is perpendicular to an alignment axis of the nozzles.

The drop generator comprises nozzles aligned on a nozzle plate along a nozzle alignment axis X. During printing, these nozzles eject inkjets continuously in a direction Z perpendicular to the nozzle plate. Continuous jet printers include deviated jet printers and binary continuous jet printers. Drops formed in deviated continuous jet printers from a nozzle during the time taken to print a position on a print support may or may not be deviated. For each print position and for each nozzle, a segment perpendicular to the movement direction of the print support is printed. Deviated drops are deviated such that they will strike the print support on the required part of the printed segment, considering the motif to be printed. Undeviated drops are recovered in a catcher or a gutter. Deviated continuous jet printers usually comprise few ejection nozzles, but each nozzle can print several pixels distributed on the print segment for each print position on the support, depending on the motif to be printed.

In binary continuous jet printers, ink from a nozzle only prints one pixel for each print position. The pixel considered does not receive any drops or receives one or several drops as a function of the motif to be printed. Consequently, for a high printing speed, the nozzle plate comprises a large number of nozzles, for example 64, to enable simultaneous printing of one pixel for each nozzle. Drops that are not required for printing are recovered in a catcher. Such printers and continuous jet print heads have been extensively described.

A general structure of a print head for a binary continuous jet printer is described below with reference to FIG. 2.

The head shown includes a drop generator 11. An integer number n of nozzles 4 are aligned on a nozzle plate 2 along an X axis, between a first nozzle $\mathbf{4}_1$ and a last nozzle $\mathbf{4}_n$.

The first and the last nozzles ($\mathbf{4}_1$, $\mathbf{4}n$) are the nozzles with the greatest distance between them.

Each nozzle has a jet emission axis parallel to a Z direction or axis (located in the plane of FIG. 2), perpendicular to the nozzle plate and to the X axis mentioned above. A third axis, Y, is perpendicular to each of the X and Z axes, the two X and Z axes extending in the plane of FIG. 2.

Each nozzle is in hydraulic communication with a pressurized stimulation chamber. The drop generator comprises one stimulation chamber for each nozzle. Each chamber is provided with an actuator, for example a piezo-electric crystal. An example design of a stimulation chamber is described in document U.S. Pat. No. 7,192,121.

There are sort means or a sort module 6 downstream from the nozzle plate, that will be used to separate drops used for printing from drops or jet segments not used for printing. FIG. 2 shows a trajectory a of ink drops passing through a slit 17, and a trajectory b of ink drops directed towards a catcher 7.

More precisely, drops or jet segments emitted by a nozzle and that will be used for printing follow a trajectory a along the Z axis of the nozzle, and then strike a print support 8, after having passed through the outlet slit 17 (shown in dashed lines in FIG. 2). The slit is open to the outside of the cavity and ink drops to be printed exit through it; it is parallel to the X direction of nozzle alignment, the Z direction axes of the nozzles passing through this slit that is on the face opposite the nozzle plate 2. Its length is equal to at least the distance between the first and the last nozzle.

Drops or jet segments emitted by a nozzle and not intended for printing, are deviated by means 6 (they follow a trajectory such as trajectory b) and are recovered in a catcher 7 and then recycled. The length of the catcher along the X direction is equal to at least the distance between the first and the last nozzle.

For example, document U.S. Pat. No. 8,540,350 (FR 2 952 851) that describes a method of avoiding crosstalk between jets from nozzles adjacent to each other, could be referred to particularly for information about the formation of jets and breaking the jets to form drops, and about the deviation of drops. Reference could also be made to prior art described in U.S. Pat. No. 7,192,121 (FR 2851495) describing jet breaking positions depending on whether a drop formed by breaking the jet will or will not strike the print support.

Liquid inks are used in continuous jet printers. These inks contain a solvent in which ink components are dissolved. It is desirable that ink should dry quickly once it has been deposited on the print support. This is why the solvents used are volatile.

The most frequently used solvents are methyl ethyl ketone known as "mek", acetone or alcohols for example such as ethanol. However, there are disadvantages related to the use of a volatile solvent. Since it is volatile, the solvent escapes from the ink in the form of vapours.

Application WO 2012/038520 includes means of overcoming the disadvantage resulting from the presence of vapour pressure around the jets. Apart from a first portion of vapour that can condense on the walls of the cavity in which the jets circulate, a second portion exits outside this cavity through a slit in the cavity through which drops necessary for printing will pass. This second part is mixed with ambient air that is thus contaminated. This contamination can lead to the refusal of an environmental quality label. When the solvent concentration exceeds a given threshold, air becomes unsuitable for breathing. Finally, if the concentration rises, the air-solvent mix can be potentially explosive.

Like this invention, the solution disclosed in application WO 2012/038520 concerns binary continuous jet printers. A small portion of ink in these printers, of the order of 10%, is directed towards the print support. This means that a preponderant part of ink emitted by the nozzles is directed towards a catcher. The different jets together form a liquid curtain that is directed towards the catcher. Only a small proportion of the ink ejected by the nozzles leaves this curtain in the form of drops directed towards the print support. These drops exit from the cavity through a slit parallel to the nozzle alignment direction. The length of this slit is slightly greater than the distance separating the nozzles with the greatest distance between each other on the nozzle plate. The liquid curtain moves towards the catcher at a velocity $V_J$. As a result of viscosity, air around this curtain is entrained in the same direction as the jets.

Air immediately in contact with the liquid is entrained at a velocity equal to approximately $V_J$. As the radial distance from the jet increases, the air velocity reduces until a limit is reached at which its velocity is low in comparison with the velocity $V_j$. The thickness of a so-called "boundary layer" is thus the distance between the liquid air boundary and the limit at which air is no longer entrained by the liquid.

The solution disclosed by application WO 2012/038520 consists firstly of using an ink with a Schmidt coefficient of about 1. This has the effect that vapour solvents emitted by the ink are almost entirely confined inside the boundary layer.

This then consists of placing the apex of the catcher so as to recover not only deviated drops not used for printing, but also air containing solvent vapour contained within the two boundary layers located on each side of the jet curtain. This is possible if the distance from the apex to the XZ plane is less than the difference in deviation of jets at the apex minus the thickness of the boundary layer. The difference in deviation of jets at the apex is the distance measured along a Y axis perpendicular to the XZ plane, between the XZ plane and the position of a deviated job at this apex.

Application WO 2012/038520 gives the formula used to calculate the thickness $\delta_2$ of the boundary layer as a function of the distance L between the nozzle plate and the apex, a numeric coefficient $\alpha$ between 3 and 5, typically 3, the kinematic viscosity of air $\nu_a$ equal to $2\times10^{-5}$ $m^2 \cdot s^{-1}$ and the velocity $V_j$ of the jets. This document also describes how to adjust the position of the catcher in a direction Y perpendicular to the XZ plane. An air flow the same as or very slightly more than the air flow drawn in by the catcher is injected approximately at the level of the nozzles, to compensate for the pressure loss inside the cavity in which the jets circulate. Air is injected parallel to the jets and along the same flow direction. Thus, a large proportion of injected air is drawn in at the catcher, and a small proportion exits through the print drops outlet slit. The positive pressure that is thus maintained in the cavity inside which the jets circulate opposes the entry of satellite drops or dust into this cavity.

But this solution is not satisfactory and cannot recover a maximum quantity of solvent vapours present in the cavity of the print head in which the jets circulate. It also limits the Schmidt coefficient of the ink used.

It is also unsuitable for high flows, for example of the order of several tens or several hundred liters per hour.

However, high flows lead to higher risks of condensation in the conduits and in the print head.

Application WO 2013/173200 describes an example of an ink and solvent recovery circuit in which the ink and gases drawn in through a catcher are directed into a pressurised ink reservoir in which ink is deposited by gravity.

Gases present above the ink in this reservoir pass through an opening into a solvent reservoir, and then into a condenser. The condensate of solvent vapours drops by gravity from the condenser into the solvent reservoir. The gas, with the condensate removed from it, is returned into the catcher. A heater that can be placed in the condenser itself heats the gases, to be sure that there is no solvent in liquid form present in the air.

Once again, this solution is not satisfactory and cannot recover a maximum amount of solvent vapours present in the cavity of the print head inside which the jets circulate and is also unsuitable for high flows, for example of the order of several tens or several hundreds of liters per hour.

BRIEF DESCRIPTION OF THE INVENTION

This invention is intended to optimise the recovery of volatile solvent used in a continuous inkjet printer. Although the invention can be applied to deviated continuous jet printers, it is particularly suitable for binary continuous jet printers in which there is a large number of jets, for example at least 16, or 32, or 64 jets (multi-jet print head), while deviated continuous jet printers have fewer jets. "Optimise recovery of volatile solvent" means firstly recovering a maximum of solvent vapours present, for example, in the cavity of the print head, and minimising the energy used for this recovery.

To achieve this, the invention relates firstly to a recovery circuit for solvent in the vaporised state, or a condensable impurity contained in a gas flow, for example originating from a cavity in a print head of an inkjet printer, comprising:

- a double flow heat exchanger, comprising a first circuit between a first inlet and a first outlet for gas flows to be treated, for example from said cavity, this exchanger comprising a second circuit between a second inlet and a second outlet,
- a condenser with an inlet with fluid coupling to the first outlet from the exchanger along the direction of circulation of the gas flow, and an outlet to evacuate condensates and gases, with fluid coupling to the second inlet of the double flow exchanger, to carry at least part of the outlet gas from the condenser to it.

The advantage of this circuit is as follows. The condenser condenses and therefore recovers solvent contained in the gas flow, for example originating from a print head. This gas flow is firstly cooled by passing through the first circuit of the exchanger, by gases from the condenser and that circulate in the second circuit of the exchanger, that are themselves heated by the gases in the first flow. Consequently, the solvent vapour pressure and the gas temperature downstream from the condenser are such that the solvent pressure is well below the saturating vapour pressure of the solvent. The gas flow at the outlet from the second circuit of the exchanger can for example be returned to a gas inlet in the print head; there is then no risk that the solvent vapour will condense on the inside walls of the cavity, in the print head, particularly if the temperature of the atmosphere inside the print head is higher than the condenser outlet temperature. Moreover, less solvent is released to the exterior because gases circulate in a closed circuit.

The invention also relates to a method of recovering a solvent or a condensable impurity contained or vaporised in a gas flow, for example originating from a cavity in a print head of an inkjet printer, comprising:

- circulation of a gas flow, for example originating from said cavity, in a first circuit of a double flow heat exchanger, comprising a first inlet and a first outlet, a second inlet and a second outlet for a second circuit, the temperature $t_1$ of this flow at the exchanger inlet, and a temperature $t_2<t_1$ at the exchanger outlet;

circulation of the flow output from the exchanger, in a condenser, the gas flow at the outlet from the condenser being at a temperature $t_3<t_2$;

circulation of the gas flow outlet from the condenser in the second circuit of the exchanger, the gas flow at the outlet from this second circuit being at a temperature $t_4>t_3$; this gas flow can be injected into the cavity.

Such a method can use a recovery device or circuit according to the invention and/or as described above.

According to another aspect, a method of recovering a solvent in the vaporised state or a condensable impurity, contained or vaporised in a gas flow, for example originating from a cavity in a print head of an inkjet printer, makes use of a recovery device or circuit according to the invention and/or as described above:

Regardless of the method used, vapours advantageously condense in the double flow heat exchanger or at its outlet, upstream from the condenser inlet. Operation of the condenser can thus be optimal.

When it is reinjected into a cavity of a print head of an inkjet printer, the gas flow can circulate in this cavity, entraining vapours in it towards a catcher or a gutter.

The gas flow injected into the cavity may for example be between 50 l/h or 100 l/h and 500 l/h.

In a method and/or a device according to the invention:

a recovery reservoir can be connected to the first inlet of the double flow exchanger and the outlet from the condenser. The gas flow then originates from this reservoir, that can also collect a liquid, and particularly condensates that flow from the condenser. In the case of an application to a print head of an inkjet printer, this reservoir is an ink and solvent recovery reservoir;

and/or the second outlet from the double flow heat exchanger can be connected to an inlet to a cavity in a print head of an inkjet printer;

and/or the double flow heat exchanger is of the passive type and/or the co-current or counter-current or cross-current type.

In a method and/or a device according to the invention, the print head may comprise the following, apart from the cavity, for the circulation of jets:

means of producing a plurality of inkjets in said cavity, means of separating firstly drops or segments of one or several of said jets used for printing, and secondly drops or segments that are not used for printing;

an open slit on the outside of the cavity for the exit of ink drops or segments intended for printing, a catcher, or a gutter, for the recovery of drops or segments not intended for printing.

According to one advantageous embodiment, the catcher or the gutter of a print head of a method or device according to the invention comprises:

a $1^{st}$ part, that includes a slit through which drops enter the catcher, the width of this $1^{st}$ part reducing along the direction of circulation of drops in the catcher, one surface of this $1^{st}$ part forming an impact surface for the deviated drops;

a restriction, the $1^{st}$ part being inclined relative to a plane ($P_0$) defined by the trajectory of jets intended for printing, from the drop inlet slit in the catcher as far as the restriction;

a $2^{nd}$ part, to evacuate gas or a mix of gas and liquid, from the restriction.

One edge of the catcher inlet slit is advantageously vertically in line with one of the edges of the slit.

Means can be provided to inject the gas from the second flow of the double flow heat exchanger into the cavity.

Means can be provided to make the gas in the second flow circulate in the cavity, preferably in an ascending manner, to the means of producing a plurality of inkjets in said cavity, and then, preferably in in a descending manner, to the catcher. For example, these means can be used to first inject gas along a direction at least partly perpendicular to a plane ($P_0$) defined by the path of jets to be used for printing.

Or these means can be used to inject gas along a direction at least partly parallel to a plane ($P_0$) defined by the path of jets to be used for printing.

According to one embodiment, the means in the cavity of circulating gas to means of producing a plurality of inkjets in said cavity, and then to the catcher, include at least one deviation surface for a gas introduced into the cavity.

According to one embodiment, the means of injecting gas in the cavity, comprise a conduit that opens up at least partially facing the catcher, or a wall that laterally delimits the catcher in the cavity relative to a plane ($P_0$) defined by the trajectory of jets to be used for printing drops.

The shape of the drop outlet slit that is open to the outside of the cavity, may advantageously diverge from the inside of the cavity towards the outside.

An inkjet printer according to the invention may comprise a print head and a recovery circuit as described above and means of supplying ink to the print head.

An inkjet printer according to the invention may comprise:

a multi-jet print head;

means of forming a fluid flow, particularly ink and/or solvent, to be sent to said print head;

means of recovering ink from said print head, comprising a circuit for the recovery of solvent in the vaporised state, according to the invention.

BRIEF DESCRIPTION OF THE DRAWINGS

Other advantages of the invention will become clear from the description of details of an example embodiment of the invention given below with reference to the appended drawings among which:

FIGS. 4B-6 are sectional views of various embodiments of a cavity in a print head in a plane perpendicular to the nozzle alignment axis on the nozzle plate.

DETAILED PRESENTATION OF EMBODIMENTS

Figure 3:
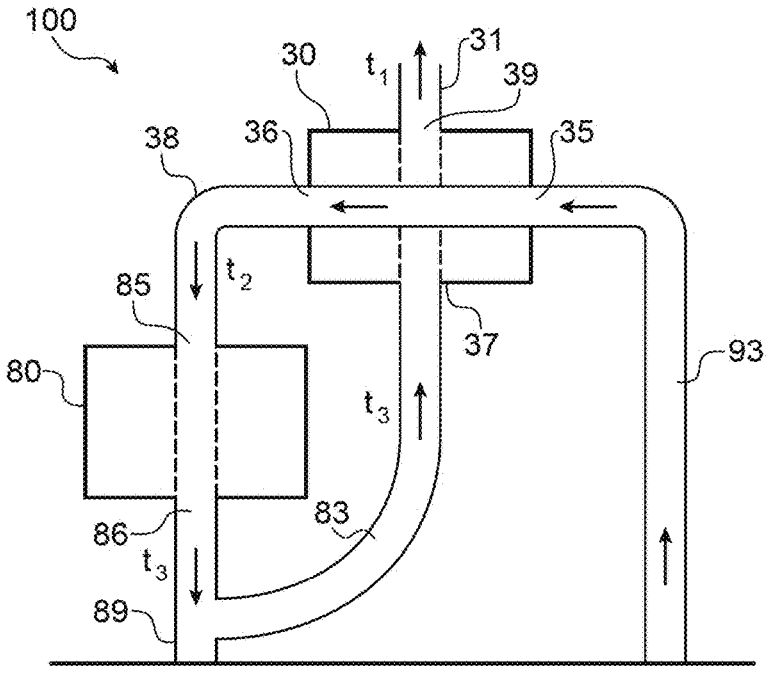
FIG. 3 is a functional diagrammatic view of an example of a solvent recovery circuit according to the invention.

FIG. 3 shown one example of a circuit 100 according to invention.

In this circuit, a double flow type exchanger 30 comprises a first circuit for circulation of a first flow between a first inlet 35 and a first outlet 36, and a second circuit for the circulation of a second flow between a second inlet 37 and a second outlet 39. The 2 flows interact thermally depending on the temperatures of each. As explained above, since the temperature of the first flow is higher than the temperature of the second flow, the $1^{st}$ flow is cooled while the $2^{nd}$ flow is heated.

The first flow may be a solvent flow from a cavity in a print head of a CIJ printer, particularly an ink recovery flow from a catcher or a gutter. Reference 93 denotes a conduit that will carry this first flow into the exchanger 30, through its first inlet 35.

The exchanger is preferably of the passive type, operating without the assistance of an energy source.

It may for example be of the co-current, or counter current or cross-current type.

When it is co-current, the two flows are arranged in parallel and circulate in the same direction. Flows in a counter-current exchanger are in parallel and in opposite directions. The two flows in a cross-current exchanger are perpendicular to each other.

The first outlet 36 from the exchanger 30 is connected through a conduit 38 to the inlet 85 of a condenser 80, for example based on Peltier cells.

The outlet from the condenser, for example connected to a conduit 89, is used to evacuate condensates and is also connected through a conduit 83 to the second inlet 37 to the exchanger 30. The second outlet 39 from this exchanger is used for the evacuation of treated gases, for example it may be connected through a conduit 31 to an inlet to the print head cavity so as to reinject gas after passing in sequence through the $1^{st}$ circuit in the exchanger 30, the condenser 8 and the $2^{nd}$ circuit in the exchanger 30.

Gas flows introduced into the $1^{st}$ circuit of the exchanger 30 comprise air and solvent vapours, at an approximately constant temperature equal to a first value $t_1$, that may be ambient temperature, for example between 5° C. and 45° C. depending on usage conditions. At the outlet 36 from the first circuit in the exchanger 30, this mix is at a temperature $t_2$ less than $t_1$, for example by a few degrees C. (for example $t_2$ may be between 2° C. and 40° C.), and is then carried through the conduit 38, from the first outlet 36 from the exchanger 30 to the inlet 85 to the condenser 80. A proportion, for example 5% to 15% by volume, of the gas flow outlet from the exchanger 30 may be condensed at the outlet from the exchanger. The gas flow can then continue its path at the outlet from the exchanger but before even entering the condenser, with a lower solvent vapour content than its initial content before it entered into the exchanger.

The gas flow temperature in the condenser 80 is lowered to a temperature $t_3$ less than $t_2$; the absolute value of the difference between $t_3$ and $t_2$ may for example be between 1° C. and 20° C. ($t_3=t_2$ if the condenser is not doing anything, for example for an ambient temperature of 0° C.; and also for example for an assembly at an ambient temperature equal for example to 15° C. or 20° C., it would be possible to have $t_3=t_2-5°$ C.)

In practice, it is preferred that the temperature $t_3$ at the outlet from the condenser is less than the lowest temperature of the system without a condenser, so that there is no condensation in the return path or in the head.

A large proportion of solvent vapours will condense due to the temperature reduction in the two elements mentioned (exchanger, condenser). It will be understood that the condenser 80 is more efficient if a first condensation, even of the order of a few %, has already taken place at the outlet from the exchanger 30. For example, if 5% to 15% of solvent vapours have been condensed at the outlet from the exchanger 30, then the condenser 80 only needs to condense a proportion of the solvent vapours, between 95% and 85% by volume in this example.

The solvent vapour condensate then flows by gravity from the exit 86 from the condenser.

Gases outlet from the condenser at temperature $t_3$ are led through the conduit 83, to the second inlet 37 of the second exchanger circuit 30. Gases in the first flow at temperature $t_1$, are cooled in the exchanger to temperature $t_2$ due to the heat exchange between the first flow at temperature $t_1$ and the second flow at temperature $t_3$. The temperature $t_2$ is between temperatures $t_1$ and $t_3$. Since the exchanger 80 lowers the temperature from $t_2$ to $t_3$, operation of the exchanger 30 is correspondingly more efficient. The temperature of the second flow at the outlet 39 of the second flow from the exchanger 30 may be fairly similar, or slightly lower than the inlet temperature $t_1$ of the first flow. Gases 39 outlet from the exchanger 30 can then be used, particularly to bring them to a gas inlet 20 of a print head 1. These gases are dry due to the condensation that has occurred, which avoids condensation of droplets in the conduits and inside the head; but their temperature is also fairly close to the operating temperature of the print head 1. Furthermore, no outside air was added because the gas flow circulated in an almost closed circuit throughout the system.

If the exchanger 30 is of the passive type, the system will not operate optimally immediately as described above. A steady state like that described above will not be set up until after an initial period.

Figure 4A:
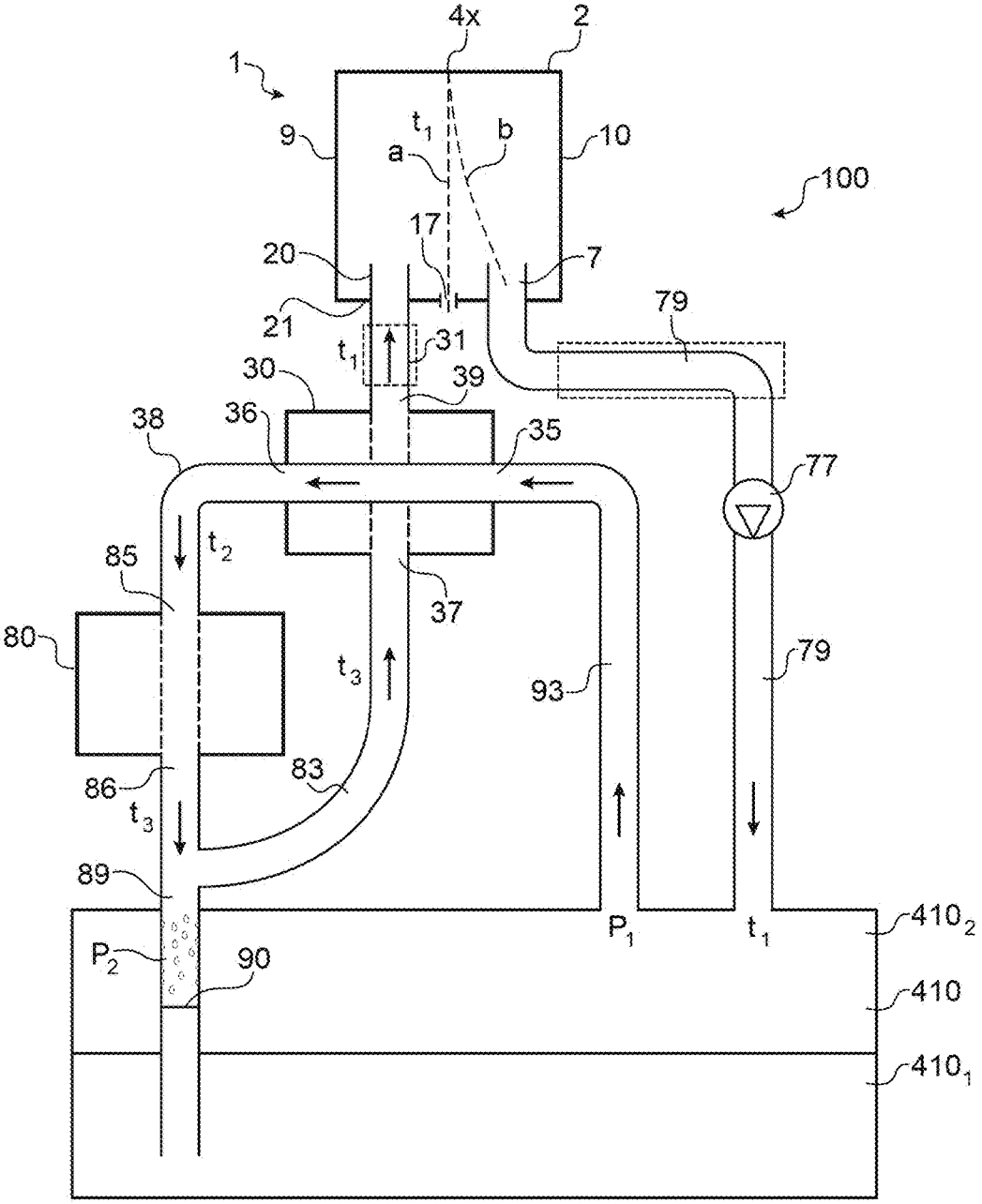
FIG. 4A is a view of an example solvent recovery circuit according to the invention, applied to a print head of an inkjet printer.

FIG. 4A represents the circuit in FIG. 3 in an environment of a print machine with an ink and solvent recovery circuit 100. As on FIGS. 4B-8, this figure shows all the elements mentioned above and also a print head 1, that in particular comprises side walls 9, 10, a catcher 7, an air inlet 20 into the print head, an upper wall 2 forming a nozzle plate, and a back wall 21, in which a slit 17 is made through which ink drops will pass before striking the print support 800.

A dashed line a on FIG. 4A represents a trajectory of ink drops passing through the slit 17, and a dashed line b represents a trajectory of ink drops towards the catcher 7.

Means of deviating the drops in the form of one or several electrodes are arranged in the cavity on the downstream side of the nozzle plate, to deviate the ink drops or segments. The term "cavity" denotes the zone in the space in which in ink circulates between the upper wall or nozzle plate and the outlet slit 17 for drops to be used for printing or between the nozzle plate and the catcher 7. The cavity is laterally limited by the walls 9, 10. The same numeric references are used on FIGS. 4B-8 and they have the same technical meaning.

Figure 2:
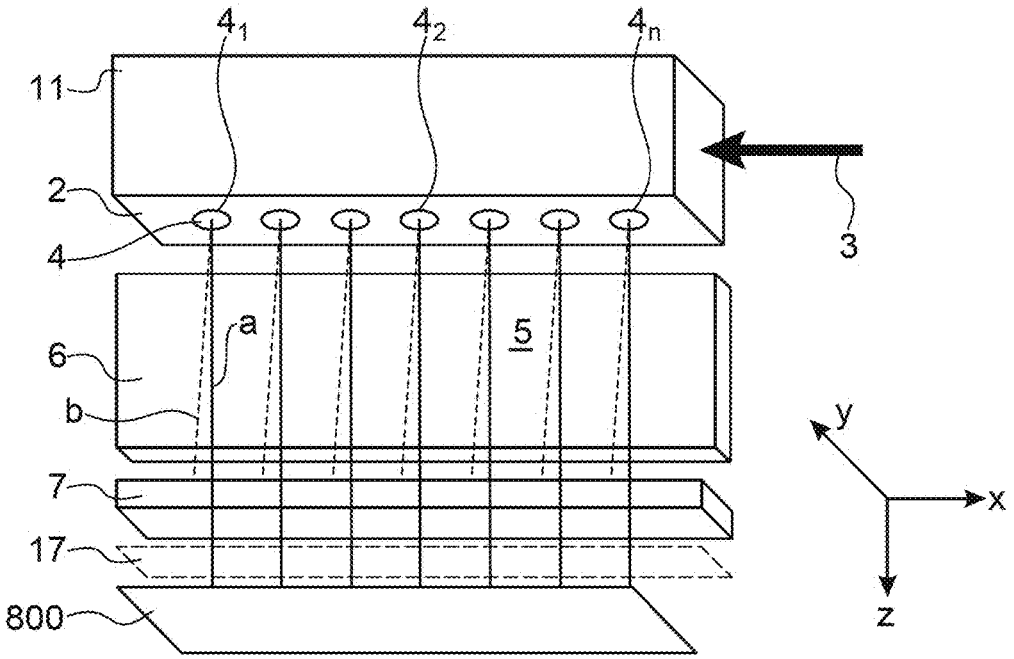
FIG. 2 represents a diagrammatic isometric view of a print head, showing principally the components of the print head located downstream from the nozzles.

The head on each of FIGS. 4A-8 is a multi-jet print head, for example comprising at least 16, or 32, or 64 jets; the head is represented in a sectional view in a plane perpendicular to the XZ plane, and containing the Z axis of a nozzle $\mathbf{4}_x$ (the orientations of the X, Y and Z axes are the same as in FIG. 2, the X axis being the nozzle alignment axis (oriented perpendicular to the figure, upwards from the plane of the figure), the Z axis being parallel to the emission axis of the jets, Y being perpendicular to the two axes X and Z y and Z extending in the plane of FIG. 4A-8). The shape of the representation of the section remains the same over the distance between the first nozzle $\mathbf{4}_1$ and the last nozzle $\mathbf{4}_n$ along the X direction. Note that the n nozzles are in line along the X axis (perpendicular to the plane of the figure), the first nozzle $4_1$ and the last nozzle $4_n$ being furthest away from each other.

Each nozzle has a jet emission axis parallel to the Z axis, perpendicular to the nozzle plate and to the X axis mentioned above.

Nozzle $4_x$ can be seen on each figure. Each nozzle is in hydraulic communication with a pressurized stimulation chamber. The drop generator comprises one stimulation chamber for each nozzle. Each chamber is provided with an actuator, for example a piezo-electric crystal. An example design of a stimulation chamber is described in document U.S. Pat. No. 7,192,121.

The drops or jet segments emitted by a nozzle and that will be used for printing follow a trajectory along the Z axis of the nozzle and strike a print support 800, after having passed through an outlet slit 17. The slit is open to the outside of the cavity and ink drops to be printed exit through it; it is parallel to the X direction of nozzle alignment, the Z direction axes of the nozzles passing through this slit, that is on the face opposite the nozzle plate 2. Its length is equal to at least the distance between the first and the last nozzle.

In the circuit illustrated in FIG. 4A, ink recovered by the catcher is circulated in a recovery circuit comprising one or several conduits 79 and at least one so-called recovery pump 77. In fact, the fluid that circulates in this recovery circuit comprises not only ink but also a gas mix containing solvent and air vapours, for example air entrained by the flow of drops in the catcher 7.

An ink reservoir 410 is placed at the inlet and outlet of the recovery circuit. Ink drops not used for printing are brought into this reservoir, together with the gas mix of solvent and air vapours. Therefore when the device is used, this reservoir contains firstly ink in the liquid state in its lower part $410_1$, and the gas mix in a part $410_2$ located above the free level of the liquid.

The inlet conduit 93 of the exchanger can be used to connect this reservoir and the first inlet 35 to the exchanger 30, while the conduit 89 couples the outlet 86 from the condenser 80 to the ink reservoir 410 (but this could be a different reservoir than the reservoir 410), into which the condensates are brought. Preferably, the conduit 89 is configured such that an open end of this conduit is always immersed in the ink contained in the ink reservoir 410, even when the ink level in this reservoir is at its minimum level. This thus prevents a head loss so that gas can be transported to the inlet of the conduit 83; a head loss could be generated in another manner, for example by creating a leak in the conduit 89.

The conduit 31 couples the second outlet 39 from the exchanger 30 to a gas inlet 20 in the print head 1. The conduits 79 and 31 are in the umbilical 200 (FIG. 1) with flows in opposite directions (the flow in conduit 31 circulating towards the head, the flow in conduit 79 circulating away from the head).

The circuit 100 may also comprise elements not shown, for example at least one pump, and/or one or several non-return valves, and/or one or several valves, and/or one or several filters. Example implantations of such elements are given in patent application FR 2.954.216 mentioned above and in application WO 2014/154830.

Apart from the functional aspects mentioned above, it is also possible that ink not used for printing and gases containing solvent vapour are drawn in through the catcher 7; everything is recovered in the reservoir 410, the gases in the upper part $410_2$, while ink drops under gravity into the lower part $410_1$ of the reservoir. The gas part containing air and solvent vapours is then led through the conduit 93 from the part $410_2$ of the ink reservoir 410 as far as the inlet 35 to the first circuit of the exchanger 30.

The system then operates as described above, all solvent having been removed from the gas injected into the $2^{nd}$ circuit of the exchanger 30, having condensed.

At the outlet from the condenser 80, the solvent vapour condensate flows by gravity in the conduit 89 as far as the part $410_1$ of the reservoir 410. The vapour pressure at the outlet 86 from the condenser 80 is reduced due to condensation. There is a head loss in the air containing vapour in the conduit 93 and then in the exchanger 30 and in the condenser, and therefore between the outlet from the reservoir 410 and the outlet 86 from the condenser. The result is that the pressure $P_2$ in the conduit 89 is less than the pressure $P_1$ present in the top part $410_1$ of the reservoir 410. This is why the solvent level 90 in the pipework 89 is higher than the ink level in the reservoir 410 as shown in FIG. 4A.

Gases 39 outlet from the exchanger 30 are brought to the gas inlet 20 of the print head 1. These gases circulate in the cavity and are then once again drawn in by the catcher 7 and the circulation of gases continues in this way in a closed circuit. Since the circuit is closed, the only possible outlet for gases contained in the cavity 5 of the print head 1 consists of the outlet orifice 17 of ink drops intended for printing.

Figure 4B:
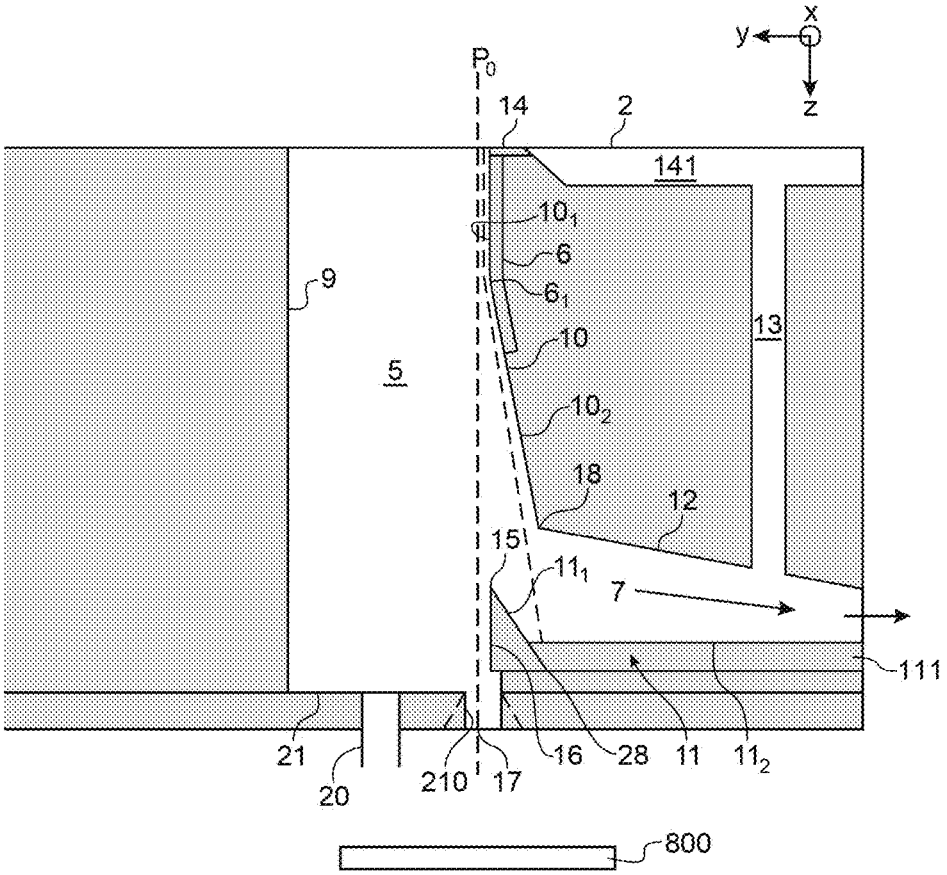

As already described above, the cavity of the print head may have the structure shown diagrammatically in FIG. 4B, but other structures are possible as shown in FIGS. 5-8.

In these FIGS. 4B-8, $P_0$ is the plane passing through the nozzle $4_x$ and that is parallel to the XZ plane. This plane is perpendicular to each of FIGS. 4B-8 and passes through all the nozzles that are aligned along X. It also passes through the centre of the slit 17. A plot of this plane is shown on these figures in dashed lines.

The upper part of the cavity is delimited by the wall 2 that also forms the nozzle plate or contains the nozzles. The lower part of the cavity is delimited by a lower wall 21 through which the slit 17 passes, and by part of the catcher 7.

Walls 9 and 10 limit the lateral extension lateral along the Y axis.

The wall 9 is located on one side of the plane $P_0$, preferably parallel to plane $P_0$ and adjacent to the nozzle plate 2. The wall 10 is located on the other side of plane $P_0$, facing the wall 9. Therefore the cavity is delimited on each side of the plane $P_0$, by these 2 walls 9 and 10. By convention, the side of the plane $P_0$ on which the wall 10 and the catcher 7 are located is called the first side of this plane, and the other side (on which the wall 9 is located) is called the second side.

The ends of the wall 10 along the X direction are adjacent to the nozzles plate 2. In the near part of the nozzle plate 2 and over a length that is preferably slightly greater than the distance between the first nozzle $4_1$ and the last nozzle $4_n$, this wall may comprise a slit 14 through which ink can be drawn in to be deposited on or close to the nozzle plate.

At the bottom of this wall 10, there is the inlet slit of the catcher 7 to recover drops that have been deviated so that they will not pass through the slit 17.

The catcher may be put into hydraulic communication with the slit 14 by means of a conduit 13 that opens up in the catcher and is located on the side of the wall 10 furthest from the plane $P_0$.

Means 6 of selection and deviation of drops not intended for printing are flush with the wall 10. These means comprise mainly electrodes. They will be connected to power supply means, not shown on the figure.

Preferably, the distance between the wall 10 and plane $P_0$, measured along the direction Y perpendicular to plane $P_0$ from plate 2 is firstly constant; this corresponds to a 1st part $\mathbf{10}_1$ of the wall 10, that is approximately parallel to $P_0$.

Then, in a second part $\mathbf{10}_2$ further away from plate 2 than the 1st part $\mathbf{10}_1$ starting from a point 61 at which the wall 10 changes direction, the distance between the wall 10 and plane $P_0$ increases with increasing distance from the nozzle plate.

This structure enables the wall 10 to be close to plane $P_0$, and parallel to it, in a 1st part of the cavity located close to the nozzles $\mathbf{4}_x$, in the zone in which the path of the drops is almost unchanged, even when the drops further downstream on this path are deviated to enter the catcher 7.

This can be seen on FIGS. 4B-8, in which a drop path is deviated towards the catcher 7: the upper part of the jet is not deviated, or is only very slightly deviated, while starting from a point 61 at which the wall 10 changes direction, the jet moves further and further away from plan $P_0$, almost linearly.

A lower part of the wall 10 and a wall 12 located further away than wall 10 from plane $P_0$, facing a wall 11, define the drop evacuation conduit or catcher (or gutter) 7, evacuating drops that will not be used for printing.

Walls 10 and 12 are preferably adjacent to each other, reference 18 designating the junction line between these two walls 10 and 12; this line is parallel or approximately parallel to the X direction. They form an upper wall of the catcher.

Wall 11 forms a lower wall of the catcher. It comprises a 1st part $\mathbf{11}_1$, furthest upstream along the direction of circulation of drops in the conduit 7 and a second part $\mathbf{11}_2$, furthest downstream.

Reference 28 designates a junction line between parts $\mathbf{11}_1$ and $\mathbf{11}_2$ of the wall 11; this line is parallel or approximately parallel to the X direction and to line 18.

The conduit 13, if it is present, can open up into the upper wall 12 and hydraulically connect the catcher 7 to a conduit 141 hydraulically connected to the slit 14.

The part $\mathbf{11}_1$ of the lower wall 11 furthest upstream, terminates at the inlet to the conduit 7 in an end part 15 that advantageously forms its apex (or vertex). This is the point on the surface 11 that is closest to the plane $P_0$.

Preferably, this apex 15 also forms part of a wall 16 that is parallel to the plane $P_0$ and that forms one of the walls surrounding or delimiting the outlet slit 17. In other words, the point of the catcher that is furthest upstream is in line with the cavity outlet slit 17. This can optimise recovery of drops: with this configuration, the catcher will recover all even slightly deviated drops. It can be noted that part 111, located under the surface 11, can be free to move laterally along the Y direction, so that the apex 15 is better positioned at the beginning of operation. This can also be the case for the other configurations presented in this application.

Wall 21 is approximately parallel to plate 2, but is also furthest from it in the cavity 5. It other words, it is located on the same side as the outlet slit 17. One end 210 of this wall forms an inlet edge of the slit 17, facing the wall 16 already mentioned above.

This wall 210, approximately perpendicular to the wall 21 and wall 16 together delimit the outlet slit 17: the drops will circulate between these 2 walls before exiting through slit 17 and colliding with the print support 800.

As a variant, the walls that delimit the slit 17 diverge from each other, as shown in dashed lines in FIG. 4B. This funnel shape prevents the capture or interception of drops that deviate slightly from their trajectory at the outlet from cavity 5, but that can still be directed towards the print support. This shape of the walls 16 and 210 can be applied to other example embodiments of the cavity described in this application.

Finally, reference 211 denotes the outside surface of the cavity into which the slit 17 opens up.

The following gives an example of the operation of these cavities.

The print head emits a continuous inkjet. Deflection of this jet is controlled by electrodes 6 to create drops that will or will not be used for printing depending on the pattern to be printed and the position of the support 800.

Drops that will be used for printing move along the Z axis (in plane $P_0$) and pass through the slit 17.

Drops that will not be used for printing are deviated from the Z axis (or the plane $P_0$), and follow a trajectory such that they collide with the lower wall 11 of the catcher 7.

Since the catcher is connected to a negative pressure source, the ink in these drops that collided with the wall 11 exit from the cavity 5 with air through the catcher.

Moreover, the conduit 13 and the slit 14 can maintain a slightly negative pressure at the nozzle plate 2. This negative pressure can absorb ink that is deposited by capillarity on the nozzle plate 2.

In the structure in FIG. 4B, gases from the exchanger 8 are introduced through one end of the conduit 20, into the end wall 21 of the cavity facing the nozzle plate 2; the outlet slit 17 is also made in this back wall 21. In the example represented, the catcher 7 is made on one side of the slit 17, while the end of the conduit 20 is located on the other side of the slit 17. The structure of the catcher 7 may for example be as described in WO 2012/038520, which facilitates the suction of solvent contained in the boundary layer.

Figure 5:
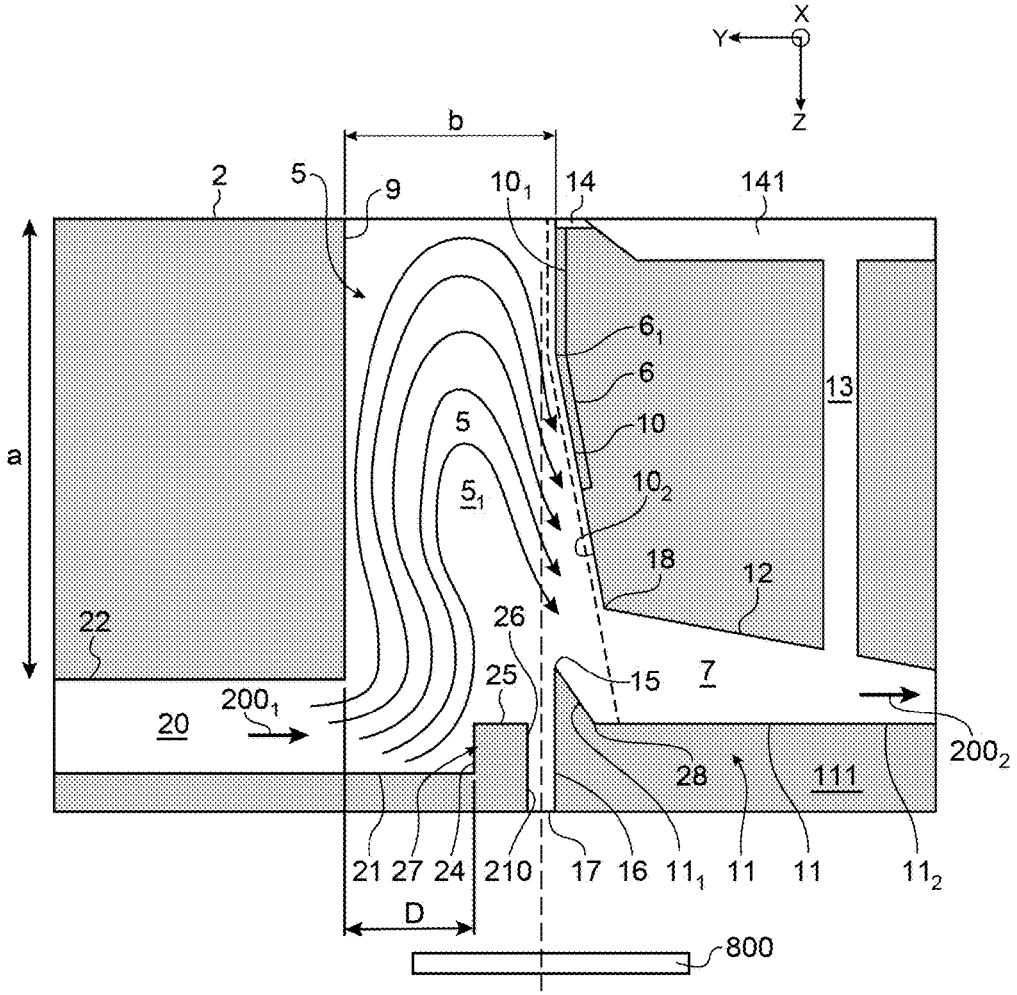

As a variant, another example of a print head structure that can be used in the framework of the invention is shown in FIG. 5, that is also a sectional view of the cavity 5 alone in which the jets circulate, this section being made along a plane parallel to the YZ plane and containing the Z axis of a nozzle 4. The shape of the representation of the section remains the same over the distance between the first nozzle $\mathbf{4}_1$ and the last nozzle $\mathbf{4}_n$ along the X direction.

References identical to those in the previous figures denote the same elements.

In the structure in FIG. 5, gases are inlet through conduit 20, at the bottom of the cavity, but laterally. This lateral cavity 20 enables communication between the cavity 5 and a pressurisation source not shown. Once again, the structure of the catcher 7 can be like that described in document WO 2012/038520. Pumping means may be connected to the catcher to suck in ink that enters the catcher.

One of the walls of this conduit 20 is wall 21; a 2nd wall 22, that faces the 1st wall and is parallel to it, joins wall 9 in which there is an opening through which the conduit opens up into the cavity. Therefore the conduit 20 is located laterally at the bottom of the cavity, in other words at the side opposite the plate 2 along the Z axis. It is also located laterally on the side opposite the side in which the catcher 7 opens up. This conduit 20 will carry a circulating air or gas flow towards the cavity 5 and approximately parallel to the wall 21, as represented by the arrow $\mathbf{200}_1$; in accordance with what was described above, this flow originates from the exchanger 30.

Means 27 are also provided in the cavity to deviate the flow 200 from its initial trajectory parallel to the wall 21, before it reaches the space above the slit 17. Thus, this gas flow will rise towards the top of the cavity, in other words towards plate 2. In the embodiment illustrated, these means 27 include for example an obstacle such as a plate or a guide or (in this case) a stud that the flow 200 will meet to be deviated as described above. The 1st wall 21 may be terminated by this obstacle, before the slit 17.

The shape of the stud 27 in the plane of the figure is approximately rectangular or square. It is delimited on the side of the conduit 20 by a face 24 parallel to plane $P_0$. D designates the distance between the plane of the wall 24 and the wall 9. This distance D is less than the distance separating the wall 8 from the plane $P_0$.

The upper part of the stud 27 is formed from a plane part 25, approximately parallel to the nozzle plate 2.

Finally, a part or wall 26 parallel to the plane $P_0$ forms a wall of the slit 17 opposite the wall 16. This wall 26 is located along the prolongation of the wall 210, already described above. The jet circulates between these walls 16, 26, before exiting from the slit 17 and colliding on the print support 800.

The walls 16 and 26 are thus located on each side of the plane $P_0$. As mentioned above, part 111 located under the surface 11, can be free to move laterally along the Y direction, so that the apex 15 is better positioned at the beginning of operation. During operation, walls 16 and 26 are preferably at an equal distance from plane $P_0$.

This cavity can function as follows: a gas jet 200 is directed through the conduit 20 to the cavity 5. Gas that thus enters the cavity 5 is deviated by the wall 24 of means 27 and is directed towards the top of the cavity, towards the nozzle plate 2. The gas then follows an upwards path in the vicinity of the wall 9, and a downwards path on the downstream side inside the boundary layer surrounding the jets.

These effects can be facilitated for some cavity configurations: let the distance measured along Z between the intersection point of walls 9 and 20 and the nozzle plate 2 be a, and the distance measured along Y between walls 9 and 10 be b, then the condition a>b facilitates the effects described above by making it possible for the vortex to be set up; if a<b, it is more difficult for the vortex to be set up (there is a risk that air will impact the jet curtain directly).

FIG. 5 represents gas circulation, materialised by curved arrows, obtained in the cavity and that results from gas injection means 20 and gas deviation means 27. This representation illustrates the fact that air will form a vortex inside the cavity 5, that will tend to concentrate the gas in the vicinity of the deviated jets; the same vortex effect is obtained with the structure in FIG. 4B.

Thus, vapours that are far from the deviated jets trajectory are returned towards it and are therefore absorbed by the catcher 7 and are evacuated as illustrated in FIG. 5 by arrow $\mathbf{200}_2$.

The gas vortex generated in the cavity 5 by circulation of gas is stable, consequently all drops that will be printed are deviated by the same distance from the Z axis. Therefore the positions of print drops relative to each other on the print support will be independent of the deviation value. The deviation, if any, is sufficiently low so that drops will continue to pass through the slit 17 without colliding with walls 16 and 26.

During operation of the cavity, suction is imposed at the outlet from the catcher 7 by a pump, or by pumping means (not shown on the figure). Furthermore, positive pressure is imposed at the inlet to conduit 20 (to force circulation of the air flow 200) by a pump, or by pumping means (not shown on the figure).

Therefore the pressure obtained can be equal to or similar to the external pressure $P_{ext}$, at a central point or zone $\mathbf{5}_1$ in the cavity. The position and the volume of this central zone $\mathbf{5}_1$ can vary depending on the pressure values imposed at the outlet from the catcher 7 and at the inlet to the conduit 20.

The presence of this zone is positive because, if the pressure inside the cavity is less than the external pressure, air will enter the cavity 5 and disturb the flow of the jets; if the pressure inside the cavity is higher than the external pressure, gas will escape from the cavity 5 and will entrain solvent vapours.

The gas flow in the cavity will circulate around zone $\mathbf{5}_1$ at a pressure close to the external pressure $P_{ext}$.

Figure 6:
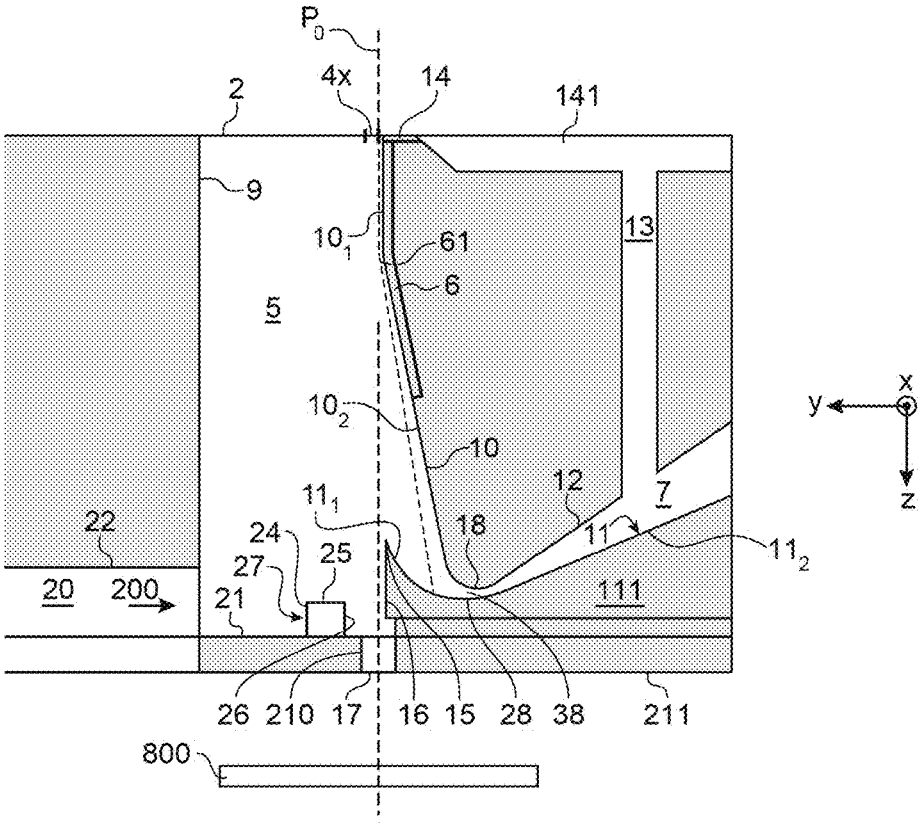

FIG. 6 represents a sectional view of another print head structure to which the invention can be applied.

Numerical references identical to those in the previous figures denote elements that are identical to or correspond to elements in the previous figures and the XYZ coordinate system is oriented as shown on FIGS. 2, 4A-4B and 5.

The main difference from the structure that has just been described with reference to FIG. 5 lies in the structure of the catcher that is curved downwards and includes an elbow.

It can be seen on this FIG. 6 that the catcher 7 comprises a 1st part $\mathbf{7}_1$, that begins at the drop inlet slit into the catcher and the section, or width of which reduces, preferably progressively, as the distance from the plane $P_0$ and the plate 2 increases. This can confer a velocity on the air flow circulating in the catcher that increases beyond the inlet to the catcher.

The first part $\mathbf{7}_1$ is in the form of a conduit included downwards in the figure, or towards a plane parallel to the XY plane and that passes through the exit slit 17.

A 2nd part $\mathbf{7}_2$ comes after the 1st part $\mathbf{7}_1$, in the direction of circulation of drops recovered in the catcher 7. The cross-section or width of this 2nd part preferably increases with increasing distance from the plan $P_0$ and with reducing distance from the plate 2. This shape can create a Venturi effect. The velocity of the air flow that circulates in this part of the catcher reduces. It would be possible to have a constant cross-section in the 2nd part within the framework of the invention, but in this case there would not be a Venturi effect.

In this second part $\mathbf{7}_2$, the catcher is in the shape of a conduit inclined towards the top of the figure, or towards the plane of the nozzle plate, to reduce the dimensions of the device; if this second part $\mathbf{7}_2$ were inclined towards the bottom of the figure, the distance between the nozzle plate 2 and the external surface 211 in which the outlet from the slit 17 is made would be increased. Therefore an attempt is made to find an average angle between the 2 parts $\mathbf{7}_1$ and $\mathbf{7}_2$, less than or equal to 90°.

The cross-section or width of the conduit of the catcher 7 may for example be measured in a plane perpendicular to the surface of one of the walls 10, 11, 12 that delimit the catcher. The cross-sections of the different parts are calculated so that the catcher generates a pressure difference of about 150 mbars, or between about 50 mbars and 500 mbars.

In a zone located between the 1st part $\mathbf{7}_1$ and the 2nd part $\mathbf{7}_2$ and in the vicinity of this zone, the conduit of the catcher 7 forms a curved portion or a restriction or an elbow 38, that will prevent ink drops from returning to the cavity 5 and that will define a zone in which the inclination of the catcher changes, this restriction 38 forming the part of the catcher furthest from the plane of the plate 2.

The progressive reduction in the cross-section from the 1st part $\mathbf{7}_1$ is such that drops in a section forming the inlet and the widest part of the catcher section can be captured efficiently. The drops are then carried in this 1st part, to a wall 11 on which they will collide, that will form a two-phase air-liquid mix that is then drawn in towards the restriction 38 that, due to its curved shape and narrowness (for example width between 50 μm and 300 or 400 μm) makes it impossible for this mix to return to the $1^{st}$ part $7_1$.

Advantageously, the $1^{st}$ part $11_1$ of the lower wall 11, is at a distance d from the plane of the nozzle plate 2 that decreases with decreasing distance from the plane $P_0$. The same applies for the portion of the wall 10 upstream from the line 18. In other words, as the distance from a point on the surface $11_1$ (or 10) to plane $P_0$ reduces, its distance from the plane of plate 2 also reduces. This part $11_1$ delimits a volume that is above the surface $11_1$ and through which ink passes before spreading on the wall $11_1$. This volume is preferably at least partly concave, which is favourable for the collection of drops that collide on this surface $11_1$. The portion of the surface 10 facing it is firstly approximately plane, and is then curved to meet the axis 18.

Reference $11_2$ denotes the part of the lower wall 11 in the conduit of the catcher 7 that is furthest downstream. In the embodiment illustrated, as explained above, the $2^{nd}$ part of the catcher is in the shape of a conduit inclined towards the top of the figure, this part $11_2$ being at a distance d from the plane of the nozzle plate 2 that decreases with increasing distance from the plane $P_0$. The same applies for the portion of the wall 12 downstream from line 18. In other words, as the distance from a point on the surface $11_2$ (or 12) from plane $P_0$ reduces, its distance from the plane of plate 2 increases. Preferably, this part $11_2$ forms an approximately plane portion of the lower wall 11. The portion of the surface 12 facing it is firstly slightly curved, close to the line 18, and is then approximately plane.

The restriction 38 that prevents ink drops from being returned to the cavity 5 is formed in and close to a zone located between lines 18 and 28. In this example, this restriction 38 is the result of the restriction in the width and then the change in the orientation of the direction of inclination of the catcher 7 that is firstly inclined downwards in the $1^{st}$ part $7_1$, and then inclined upwards in the $2^{nd}$ part $7_2$. As explained above, the smallest cross-section or width of the catcher, as defined above, is in this restriction 38.

Operation of this cavity and its advantages are as described above, but the restriction 38 formed in the vicinity of lines 18 and 28 prevents drops from returning to the cavity 5.

In FIG. 6, the position of the conduit 20 is the same as in FIG. 5, therefore refer to the explanations given above for the structure of this conduit and the effect that it creates; as a variant, a conduit like that shown in 4B is also possible, for gas injection through the bottom of the cavity.

The gas flow out from the $2^{nd}$ circuit of the double flow exchanger 30 in the different head structures described above is sent through the conduit 20 from the print head 1 towards the cavity 5.

This gas flow is drawn into the cavity of the print head to the nozzle plate 2 under the effect of the negative pressure that is set up there due to the air entrainment effect of the jets. Consequently, air follows a path in the upstream direction close to the wall 9, and then a path in the downstream direction inside the boundary layer surrounding the jets; this is the path represented in FIG. 5 materialised by arrows, each arrow materialising the direction of air at the location of the arrow. Therefore, it can be understood that air forms a vortex inside the cavity 5 that concentrates air close to the trajectory of the deviated jets. Solvent vapours that are far from the trajectory of the deviated jets are thus brought towards this trajectory and are absorbed by the catcher 7.

Note that the advantage of using an ink with a Schmidt coefficient of close to 1 is to confine a major part of solvents inside the hydrodynamic boundary layer. Vapours that escape from this boundary layer are recovered as a result of the embodiments described above. These embodiments make it possible to relax the constraint on the Schmidt coefficient of the ink because solvent vapours that escape from the boundary layer are recovered in the vortex formed due to the particular configuration of the air inlet. Therefore this coefficient can be chosen to be up to a high value, for example up to 5 or more than 1 and less than 5.

Furthermore, since the outlet of the gases from the cavity passes almost entirely through the catcher 7, very little gas escapes through the outlet orifice 17 of ink intended for printing. A result of this is that a maximum amount of solvent is recycled.

The inventors made a simulation for the case of a structure with lateral injection of gas, and with a catcher of the type described with reference to FIG. 6. To achieve this, they selected air inlet conditions in the cavity 5 in order to obtain the vertex and used the Comsol® software. This software uses a breakdown of the volume of the cavity into finite elements using a certain mesh. The result obtained is a value of the flow and flow conditions inside mesh elements in which we are interested. In the present case, a constraint related to the direction of the velocity vector at the XZ plane is added; this constraint is that the component of the velocity vector of gases in finite elements containing part of the XZ plane is significantly higher than the component perpendicular to this plane. Thus, this results in the minimum possible disturbance to the direction of print drops. In this manner, the air flow along Y disturbs the jet trajectory as little as possible.

Figure 7:
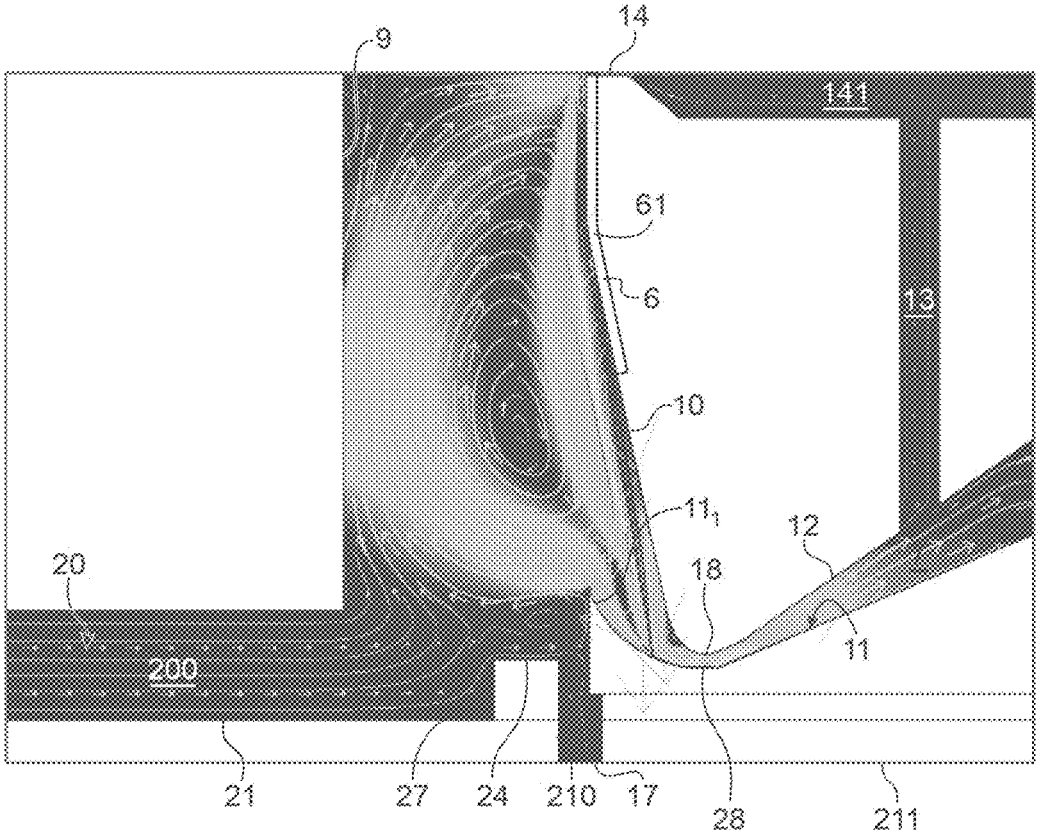
FIG. 7 shows a simulation of air circulation in a cavity of a print head.

FIG. 7 represents the result of such a simulation. It can be seen that the gas at the outlet from the conduct 20 is deviated towards the top of the cavity, circulates along the wall 9, joins the nozzle plate 2, and is then returned to the catcher 7.

Air circulates around the point or the zone at a pressure close to the external pressure (atmospheric pressure).

As can be seen in FIGS. 5 and 7, air circulation generated in the cavity brings solvent vapours present in the cavity towards the catcher with the deviated ink flow. The position of the conduit 20 at the bottom of the cavity on the side of the slit 17, can result in an injected gas trajectory, firstly ascending in the cavity towards the plate 2, and then descending towards the catcher 7.

Figure 8:
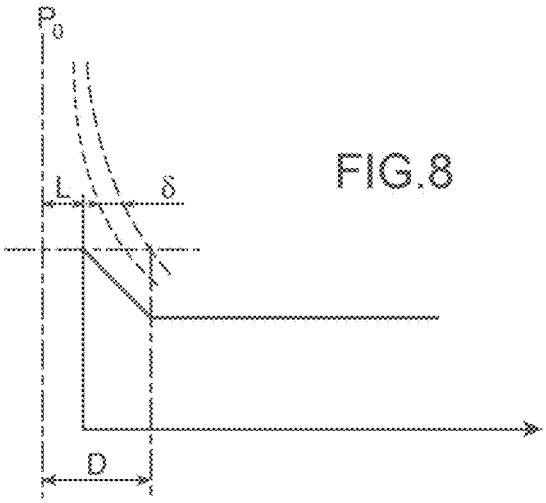
FIG. 8 shows a detail of a cavity in one embodiment of a print head according to the invention.

As illustrated in FIG. 8, regardless of the shape of the catcher, the apex of the catcher is advantageously located at a distance L from plane $P_0$ less than or equal to the difference D in jet deviation at this apex (along the Z axis), minus the thickness δ of the boundary layer around the deviated jets at this apex.

A device according to the invention is supplied with ink by an ink reservoir not shown on the figures. Various fluid connection means can be used to connect this reservoir to a print head according to the invention, and to recover ink originating from the catcher. An example of a complete circuit that can be used in combination with this invention is described in U.S. Pat. No. 7,192,121.

Regardless of the envisaged embodiment, the instructions to activate means $4_1$-$4_n$ to produce inkjets and catcher pumping means, possibly to activate the condenser 80 and/or the exchanger 30, and/or means of sending gas into the cavity are sent by control means (also called "controller"). These are the instructions that cause circulation of ink under pressure towards the means $4_1$-$4_n$ then to generate jets as a function of motifs to be printed on a support 800. These control means may for example be made in the form of a processor, or a programmable electric or electronic circuit, or a microprocessor programmed to implement a method according to the invention.

This controller controls means $4_1$-$4_n$ pumping means of the printer and particularly the catcher, and the means of sending gas into the cavity and/or opening and closing valves on the trajectory of the different fluids (ink, solvent, gas). The control means can also memorise data, for example data for measurement of ink levels in one or more of the reservoirs, and process these data.

Figure 1:
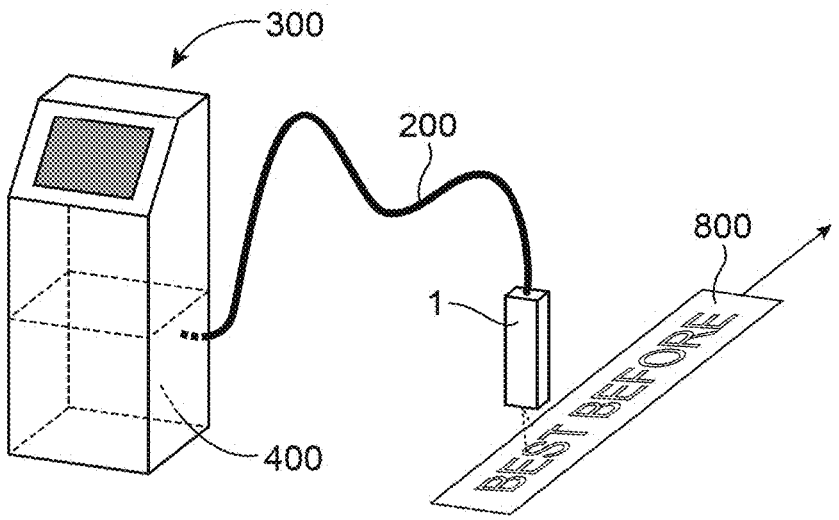
FIG. 1 is a perspective view of an inkjet printer known in prior art.

FIG. 1 shows the main blocks of an inkjet printer that can implement one or several of the embodiments described above.

Such a printer comprises a print head 1 and means 200, 300, 400 of supplying printing ink to the head. The print head is connected to a recovery circuit like that described above.

A printer according to the invention may comprise a console 300, a compartment containing particularly the ink and solvent conditioning circuit 400, and reservoirs for ink and solvents (in particular, the reservoir to which ink recovered by the catcher is delivered). In general, this compartment is in the lower part of the console. The top part of the console comprises the control and instrumentation electronics and display means. The console is hydraulically and electrically connected to a print head 1 through an umbilical 200.

A portal frame not shown is used to install the print head facing a print support 800, which moves along a direction materialised by an arrow. This direction is perpendicular to an alignment axis of the nozzles.

The drop generator comprises nozzles and a cavity of the type according to one of the embodiments described above.

Figure 9:
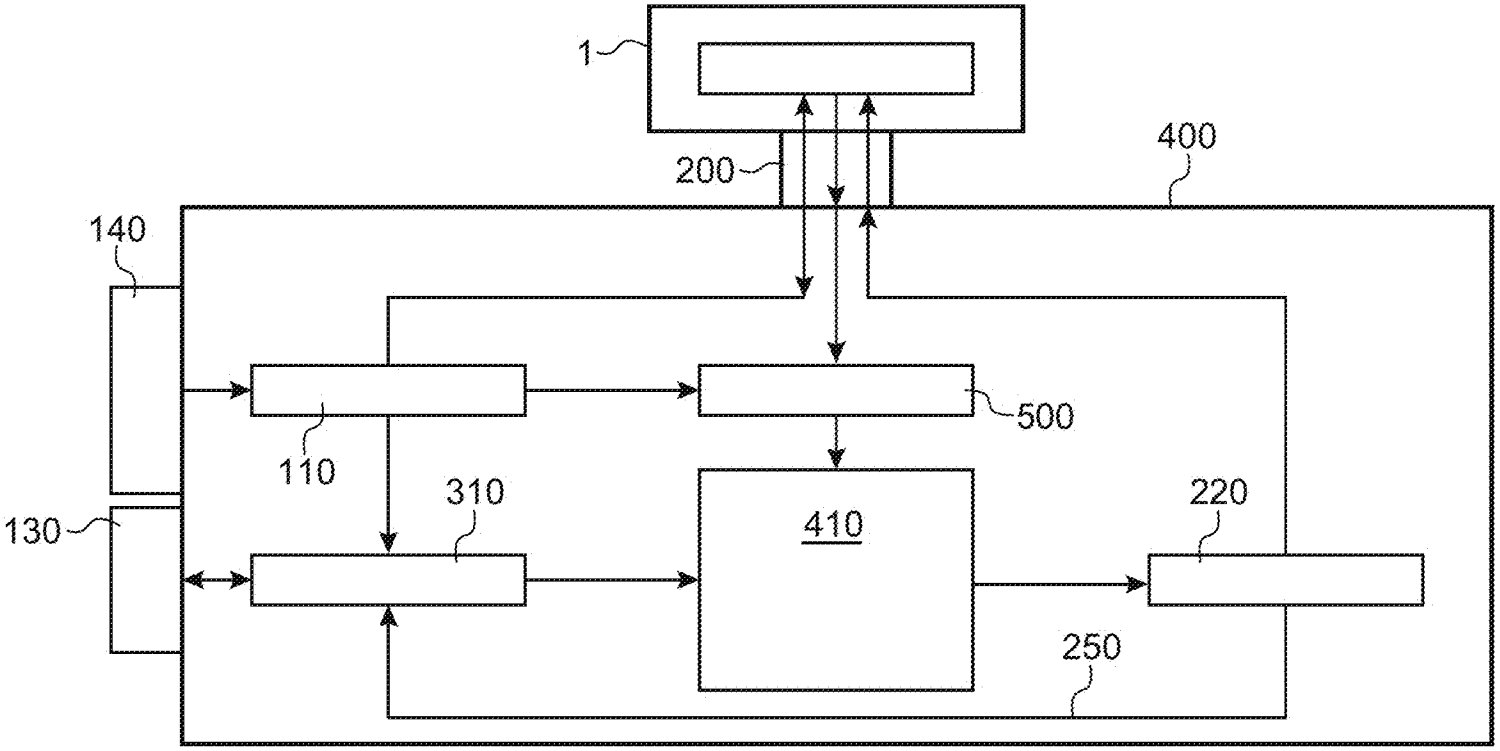
FIG. 9 shows an example structure of a fluid circuit to which the invention might be applied.

An example of a fluid circuit 400 of a printer to which the invention can be applied is illustrated in FIG. 9. This fluid circuit 400 comprises a plurality of means 410, 500, 110, 220, 310, each associated with a special function. There is also the head 1 and the umbilical 200.

This circuit 400 is associated with a removable ink cartridge 130 and a solvent cartridge 140 that is also removable.

Reference 410 designates the main reservoir, that collects a mix of solvent and ink.

Reference 110 designates means of drawing off and possibly storing solvent from a solvent cartridge 140 and providing solvent thus drawn off to other parts of the printer, either to supply solvent to the main reservoir 410, or to clean or maintain one or several other parts of the machine.

Reference 310 designates all means of drawing off ink from an ink cartridge 130 and providing ink thus drawn off to supply the main reservoir 410. As can be seen on this figure, according to the embodiment presented herein, these same means 310 are used to send solvent to the main reservoir 410 from the means 110.

At the outlet from the reservoir 410, a set of means globally designated as reference 220 applies pressure to the ink drawn off from the main reservoir and sends it to the print head 1. According to one embodiment illustrated herein by the arrow 250, it is also possible to use these means 220 to send ink to the means 310, and then again to the reservoir 410, which enables recirculation of ink inside the circuit. This circuit 220 is also used to drain the reservoir in the cartridge 130 and to clean connections of the cartridge 130.

The system shown on this figure also includes means 500 of recovering fluids (ink and/or solvent) that return from the print head, more precisely from the catcher 7 of the print head or the head rinsing circuit. Therefore these means 500 are arranged downstream from the umbilical 200 (relative to the direction of circulation of fluids that return from the print head). In particular, they include means 77, 79 in FIG. 4A, but also a solvent recovery circuit according to one embodiment of the invention.

As can be seen in FIG. 9, the means 110 can also be used to send solvent to these means 500 directly without passing through the umbilical 200 or through the print head 1 or through the catcher.

The means 110 can comprise at least 3 parallel solvent supplies, one to the head 1, the $2^{nd}$ to the means 500 and the $3^{rd}$ towards the means 310.

Each of the means described above is provided with means such as valves, and particularly solenoid valves, that can direct the fluid concerned to the chosen direction. Thus, starting from means 110, solvent can be sent exclusively to the head 1, or to means 500 or to means 310.

Each of the means 500, 110, 210, 310 described above can be provided with a pump to treat the fluid concerned (respectively $1^{st}$ pump, $2^{nd}$ pump, $3^{rd}$ pump, $4^{th}$ pump). These different pumps perform different functions (the functions of each of their means) and are therefore different from each other, even though these different pumps may be of the same type or of similar types (in other words none of these pumps performs 2 of these functions).

In particular, the means 500 comprise a pump ($1^{st}$ pump) that pumps the fluid recovered from the print head as explained above, and directs it to the main reservoir 410. This pump corresponds to pump 77 represented in FIG. 4A; it is dedicated to the recovery of fluid from the print head and is physically different from the $4^{th}$ pump of means 310 dedicated to the transfer of ink or the $3^{rd}$ pump of means 210 dedicated to pressurisation of ink at the outlet from reservoir 410.

The means 110 comprise a pump (the $2^{nd}$ pump) that pumps solvent and sends it to the means 500 and/or the means 310 and/or to the print head 1.

Such a circuit 400 is controlled by the control means described above and are usually contained in the console 300.

The invention is particularly useful in applications in which the air or gas flow in the cavity is high, since a large air flow introduces to a correspondingly larger risk of allowing solvent to escape.

For example, the flow may be of the order of several tens or hundreds of l/h, for example between 50 l/h or 100 l/h and 500 l/h, for example about 300 l/h.

These values are particularly applicable to the case of a nozzle plate with 64 nozzles, but the invention is also applicable to the case of a nozzle plate with a smaller number of nozzles, for example 32, or to the case of a nozzle plate with a larger number of nozzles, for example 128. The jet velocity may be between 5 m/s and 20 m/s, for example it is about 15 m/s.

The invention claimed is:

1. Circuit for recovery of solvent in the vaporised state from a cavity, comprising:

said cavity in a print head of an inkjet printer, said cavity configured for containing solvent in a vaporised state, a double flow heat exchanger comprising a first circuit between a first inlet and a first outlet, for a gas flow from said cavity, the double flow heat exchanger comprising a second circuit thermally coupled to the first circuit and located between a second inlet and a second outlet, wherein fluid exiting the second outlet of the double flow heat exchanger is conveyed to the cavity without additional heating, a condenser with an inlet and an outlet, the inlet with fluid coupling to the first outlet from the double flow heat exchanger, along the direction of circulation of the gas flow wherein fluid exiting the first outlet of the double flow heat exchanger is conveyed to the inlet of the condenser without additional heating or cooling, and the outlet of the condenser is directly coupled to the second inlet of the double flow heat exchanger.

2. Circuit according to claim 1, in which the first inlet to the double flow heat exchanger and the outlet from the condenser are connected to at least one reservoir.

3. Circuit according to claim 1, in which the second outlet from the double flow heat exchanger can be connected to an inlet to said cavity.

4. Circuit according to claim 1, the double flow heat exchanger being of the passive type or being of the co-current, counter-current or cross-current type.

5. Circuit according to claim 1, also comprising a print head comprising:

the cavity, for circulation of jets;

a plurality of nozzles for producing a plurality of inkjets in said cavity, electrodes to separate drops or segments of one or several of said jets used for printing, from drops or segments that are not used for printing;

an open slit on the outside of the cavity for the exit of ink drops or segments intended for printing, a catcher for the recovery of drops or segments not intended for printing.

6. Circuit according to claim 5, the gutter comprising a $1^{st}$ part, that includes a slit through which drops enter the catcher, the width of this $1^{st}$ part reducing along the direction of circulation of drops in the catcher, one surface of this $1^{st}$ part forming an impact surface for the deviated drops;

a restriction, the $1^{st}$ part being inclined relative to a plane defined by the trajectory of jets intended for printing, from the drop inlet slit in the catcher as far as the restriction;

a $2^{nd}$ part, to evacuate gas or a mix of gas and liquid, from the restriction.

7. Circuit according to claim 5, one edge of the catcher inlet slit being vertically in line with one of the edges of the slit.

8. Circuit according to claim 5, also comprising a conduit injecting gas from the second circuit of the double flow heat exchanger into the cavity.

9. Circuit according to claim 8, said gas circulating in the cavity to the plurality of nozzles and then to the catcher.

10. Circuit according to claim 8, said conduit enabling injection of gas along a direction at least partly perpendicular to a plane ($P_0$) defined by the path of jets to be used for printing.

11. Circuit according to claim 8, including at least one deviation surface for a gas introduced into the cavity.

12. Circuit according to claim 8, said conduit opening up at least partially facing the catcher, or a wall that laterally delimits the catcher in the cavity relative to a plane defined by the trajectory of jets to be used for printing drops.

13. Inkjet printer comprising:

a multi-jet print head;

a circuit for forming a fluid flow to be sent to said print head;

a circuit for recovering ink from said print head, comprising a circuit for the recovery of solvent according to claim 1.

* * * * *